US006829461B2

(12) United States Patent
Arai et al.

(10) Patent No.: US 6,829,461 B2
(45) Date of Patent: Dec. 7, 2004

(54) RECOVERED TONER CLASSIFIER CAPABLE OF EFFECTIVELY REMOVING FOREIGN SUBSTANCE AND CRUSHING AGGREGATION OF TONER

(75) Inventors: Yuji Arai, Kanagawa (JP); Satoshi Takano, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 55 days.

(21) Appl. No.: 10/092,488

(22) Filed: Mar. 8, 2002

(65) Prior Publication Data

US 2002/0127031 A1 Sep. 12, 2002

(30) Foreign Application Priority Data

| | | |
|---|---|---|
| Mar. 8, 2001 | (JP) | 2001-064742 |
| Jan. 22, 2002 | (JP) | 2002-012412 |
| Feb. 8, 2002 | (JP) | 2002-032063 |

(51) Int. Cl.[7] ..... G03G 15/08
(52) U.S. Cl. ..... 399/253; 399/359
(58) Field of Search ..... 399/98, 358, 359, 399/253; 209/913, 919, 390

(56) References Cited

U.S. PATENT DOCUMENTS

| | | | | |
|---|---|---|---|---|
| 3,894,514 A | | 7/1975 | Caudill et al. | |
| 4,054,381 A | * | 10/1977 | Bernhard | 399/359 |
| 4,167,975 A | * | 9/1979 | Fahrenholz | 171/12 |
| 4,298,268 A | * | 11/1981 | Sato et al. | 399/99 |
| 4,389,968 A | * | 6/1983 | Satomura | 399/359 |
| 4,466,730 A | | 8/1984 | Jugle | |
| 4,876,573 A | * | 10/1989 | Kamimura | 399/266 |
| 5,200,788 A | * | 4/1993 | Thayer | 399/359 |
| 5,502,549 A | * | 3/1996 | Hart et al. | 399/98 |
| 5,557,386 A | | 9/1996 | Meguro et al. | |
| 5,710,960 A | * | 1/1998 | Hart et al. | 399/253 |
| 5,950,062 A | * | 9/1999 | Yahata et al. | 399/358 |
| 6,123,841 A | * | 9/2000 | Gotoh | 210/169 |

FOREIGN PATENT DOCUMENTS

| | | |
|---|---|---|
| DE | 31 20 724 | 2/1982 |
| DE | 199 48 888 | 8/2000 |
| JP | 6-337589 | 12/1994 |
| JP | 7-77906 | 3/1995 |
| JP | 7-210050 | 8/1995 |
| JP | 10-207236 | 8/1998 |
| JP | 10-260583 | 9/1998 |
| JP | 2000-200020 | 7/2000 |

OTHER PUBLICATIONS

U.S. Appl. No. 10/742,835, filed Dec. 23, 2003, Tsuda et al.
U.S. Appl. No. 10/740,665, filed Dec. 22, 2003, Nagashima et al.
U.S. Appl. No. 10/660,636, filed Sep. 12, 2003, Ishii et al.
U.S. Appl. No. 10/636,637, filed Aug. 8, 2003, Hosokawa et al.
U.S. Appl. No. 10/452,295, filed Jun. 3, 2003, Kawahara et al.
U.S. Appl. No. 10/418,111, filed Apr. 18, 2003, Kawahara et al.

* cited by examiner

*Primary Examiner*—Robert Beatty
(74) *Attorney, Agent, or Firm*—Oblon, Spivak, McClelland, Maier & Neustadt, P.C.

(57) ABSTRACT

A recovered toner classifier includes a rotatable cylindrical-shaped filter and a fur brush having a brush spirally provided on an outer peripheral surface of a rotation shaft. A non-brush region is continuously formed from the inlet of the filter for the recovered toner through the outlet of the filter for discharging the disposal toner along the axis line of the rotation shaft. The fur brush integrally rotates with the rotation shaft with a tip portion of the brush is in press-contact with an inner peripheral surface of the filter. A screw conveyer having a screw on a portion of the rotation shaft on a side of the inlet of the filter for the recovered toner is provided to convey the recovered toner to the inlet of the filter for the recovered toner.

23 Claims, 10 Drawing Sheets

RECOVERED TONER CLASSIFIER CAPABLE OF EFFECTIVELY REMOVING FOREIGN SUBSTANCE AND CRUSHING AGGREGATION OF TONER

BACKGROUND OF THE INVENTION

1. Field of the Invention

The present invention relates to a recovered toner classifier to be used in an image forming apparatus, such as a copying machine, a facsimile, a printer, and other similar devices, and more particularly to a recovered toner classifier that can effectively classify recovered toner into toner to be reused and toner to be disposed of.

2. Discussion of the Background

An image forming apparatus generally includes a cleaning device. The cleaning device is provided to recover residual toner remaining on an image bearing member, such as a photoconductive element and intermediate transfer belt after a toner image has been transferred onto a transfer sheet. The cleaning device is also provided to a sheet conveying device, which conveys the transfer sheet having the toner image thereon to a fixing device, to recover unfixed toner (i.e., residual toner).

FIG. 11 is a schematic drawing illustrating a sectional view of a toner recycle device having components arranged around a photoconductive drum, and a recovered toner conveying path in a background image forming apparatus. A charging device 17, a cleaning device 18, a developing device 19 and a transfer device 20 are arranged around a photoconductive drum 16. A recovered toner conveying mechanism 21 is provided between the cleaning device 18 and developing device 19.

In recent years, the demand for effective use of resources is constantly increasing. Thus, the need for recycling toner removed from the photoconductive drum 16, etc., is growing. Various types of devices, which convey toner recovered by the cleaning device to a developing device or a toner replenishing device, have been proposed. Because recovered toner includes an aggregation of toner having large particle size and paper lint, if the recovered toner is reused as it is, an abnormal image is produced, such as an image having black spots and blank portions.

In Japanese Patent Laid-Open Publication Nos. 6-337589, 10-207236, 7-77906, and 10-260583, a recovered toner classifier having a mesh filter is discussed. The recovered toner classifier is provided between the recovered toner conveying mechanism 21 and developing device 19 to remove the aggregation of toner and paper lint in the recovered toner.

In the toner recycle device discussed in Japanese Patent Laid-Open Publication No. 6-37589, recovered toner is conveyed into the recovered toner classifier. A recovered toner replenishing roller then presses the recovered toner disposed on the filter to crush the aggregations of toner. The toner passing through the filter is then conveyed to the developing device for reuse. In the toner recycling device discussed in Japanese Patent Laid-Open Publication No. 10-207236, the filter is provided in a mid-portion of the recovered toner conveying path. A disposal toner conveying path is provided below the filter. Thus, the toner remaining on the filter is reused. In a recovered toner classifier discussed in Japanese Patent Laid-Open Publication No. 10-260583, the recovered toner conveyed through a recovered toner conveying path is conveyed into a cylindrical-shaped filter. The filter is then vibrated to classify the recovered toner into toner to be reused and toner to be disposed of.

However, in the devices discussed in the above-described Japanese Patent Laid-Open Publications, recovered toner including a large aggregation of toner and paper lint may not be satisfactorily classified into toner to be reused and toner to be disposed of.

SUMMARY OF THE INVENTION

The present invention has been made in view of the above-mentioned and other problems and addresses the above-discussed and other problems.

The present invention advantageously provides a novel recovered toner classifier that can effectively remove foreign substances such as paper lint included in recovered toner, and crush aggregations of toner in the recovered toner.

According to an example of the present invention, the recovered toner classifier includes a rotatable cylindrical-shaped filter having an inlet for the recovered toner at one end of the filter in a direction of its length and an outlet for discharging the disposal toner at the other end of the filter, and a fur brush having a brush spirally provided on an outer peripheral surface of a rotation shaft and a non-brush region continuously formed from the inlet of the filter for the recovered toner through the outlet of the filter for discharging the disposal toner along the axis line of the rotation shaft. The fur brush is concentrically contained in the filter such that the fur brush integrally rotates with the rotation shaft with a tip portion of the brush in press-contact with an inner peripheral surface of the filter. A screw conveyer having a screw provided on a portion of the rotation shaft on a side of the inlet of the filter for the recovered toner is arranged to convey the recovered toner to the inlet of the filter for the recovered toner.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 8 is a drawing illustrating a sectional view of a construction of the recovered toner classifier according to the second example of the present invention;

DETAILED DESCRIPTION OF THE PREFERRED EMBODIMENTS

Figure 1:
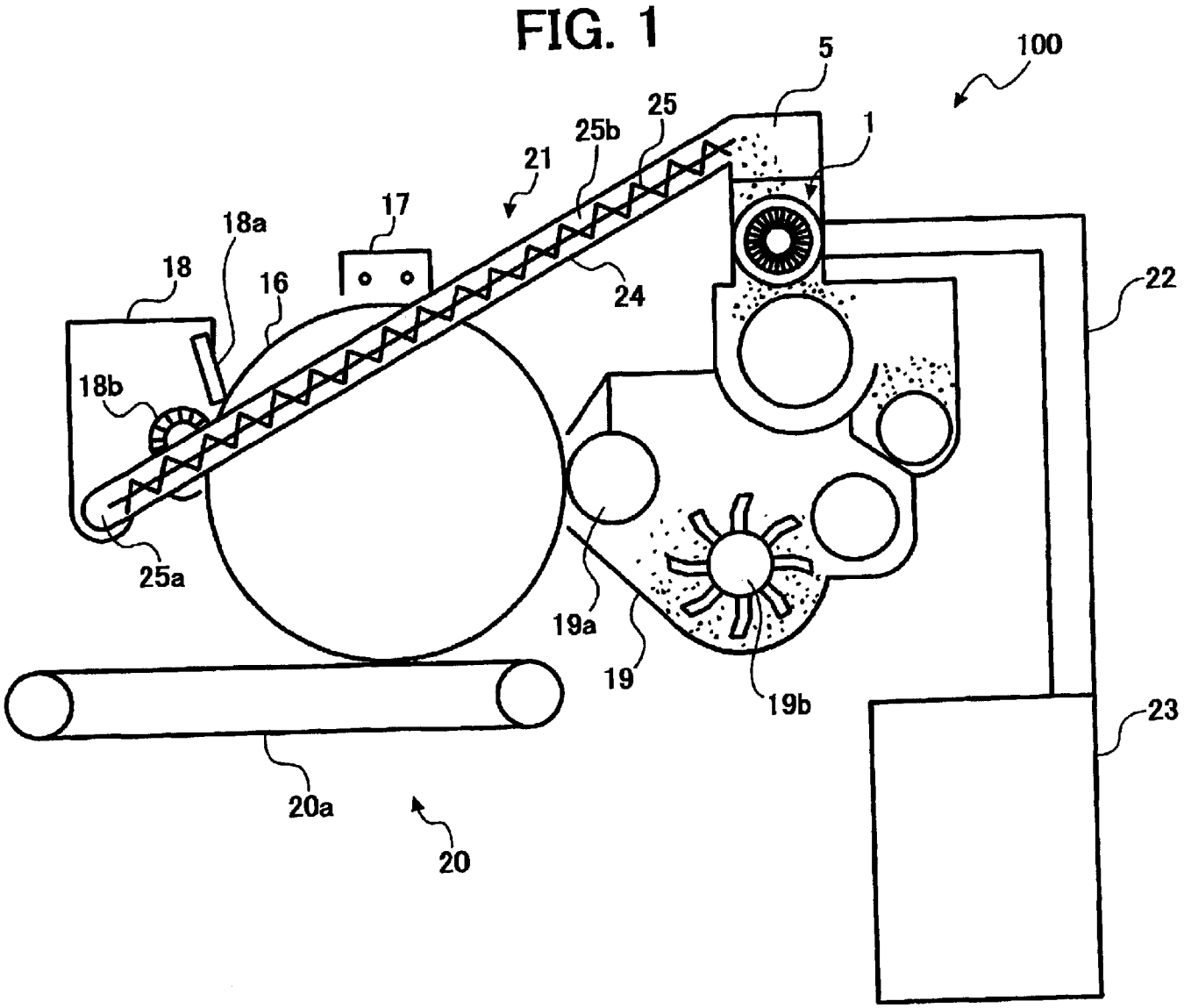
FIG. 1 is a schematic drawing illustrating a sectional view of a toner recycle device including a recovered toner classifier according to a first example of the present invention.

Referring now to the drawings, wherein like reference numerals designate identical or corresponding parts throughout the several views, a first example of the present invention is first described.

Figure 2:
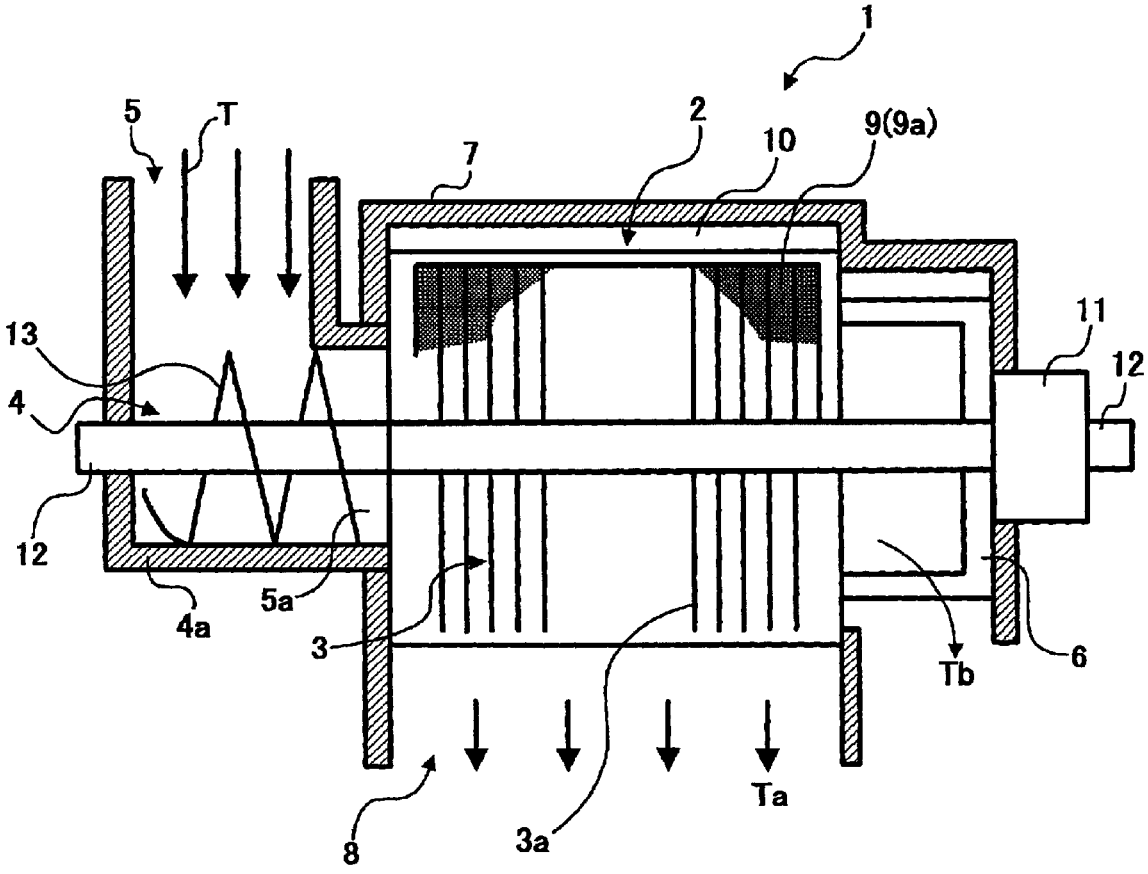
FIG. 2 is a drawing illustrating a longitudinal sectional view of the recovered toner classifier in FIG. 1.
Figure 3:
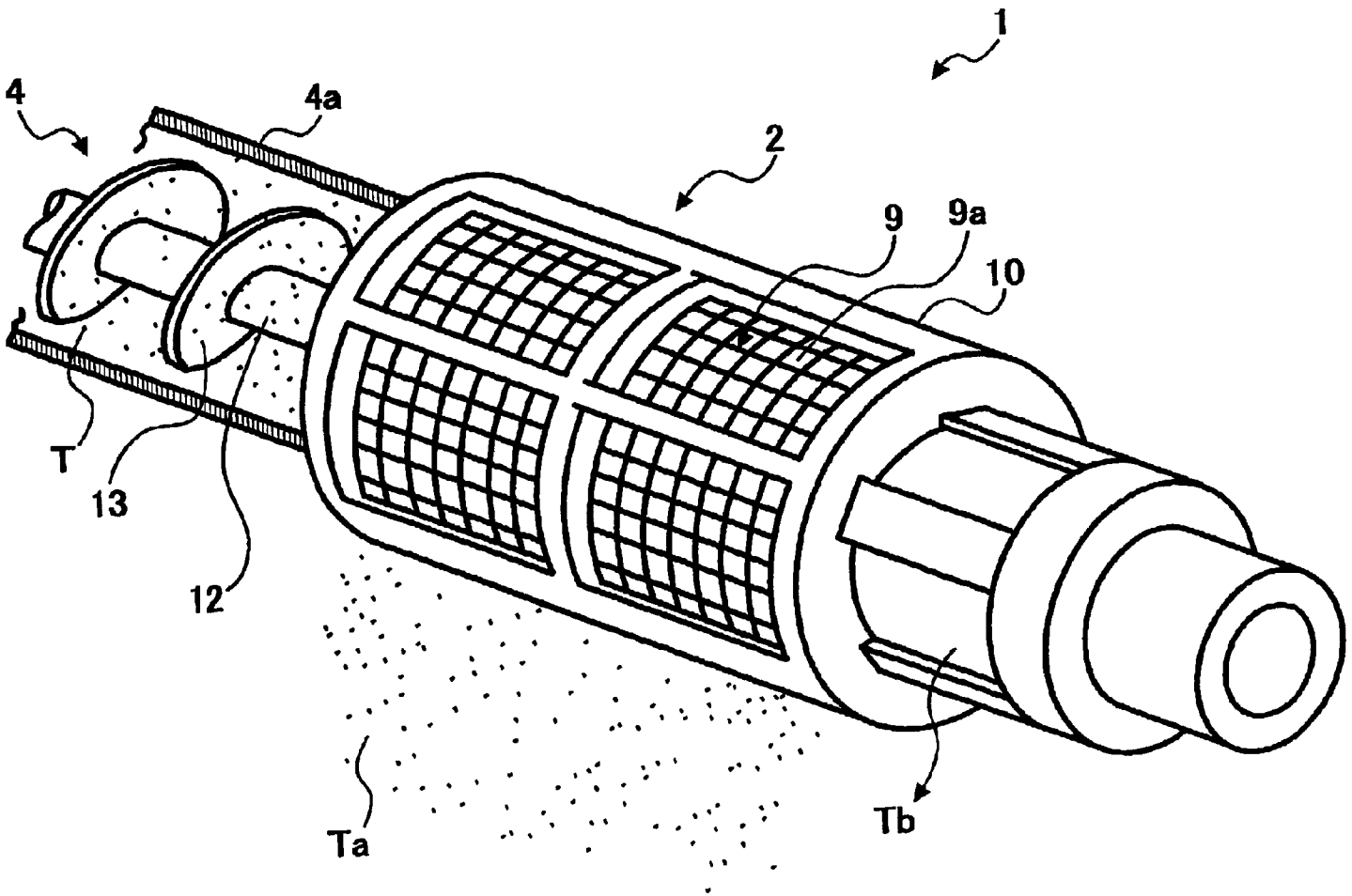
FIG. 3 is a drawing illustrating a perspective view of a main construction of the recovered toner classifier in FIG. 1.
Figure 4A:
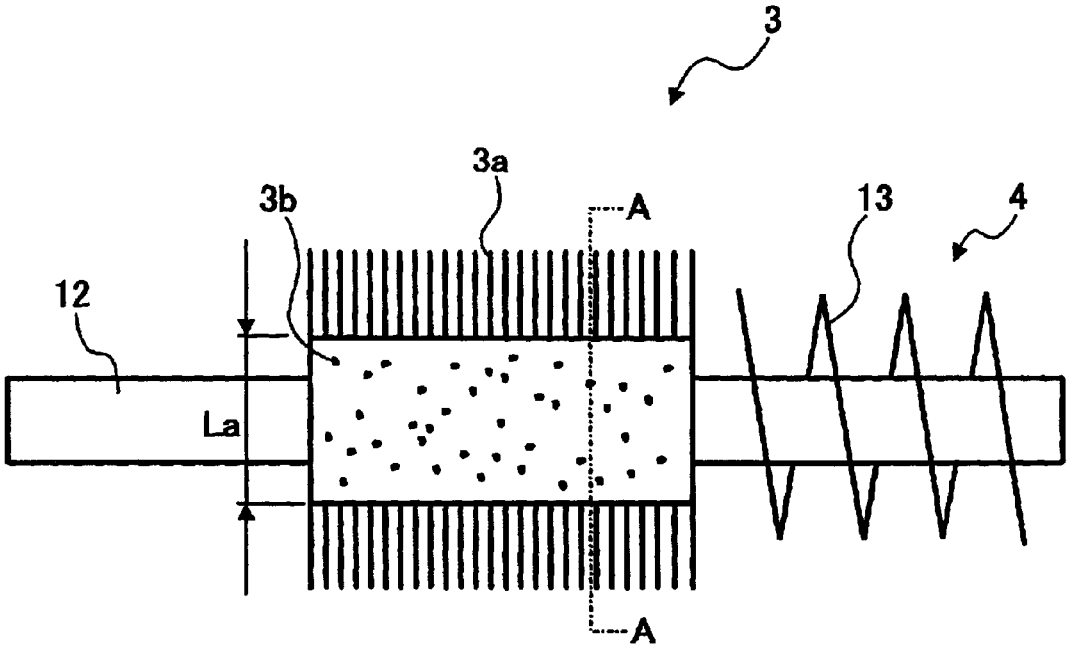
FIG. 4A is a drawing illustrating a longitudinal sectional view of an example of a fur brush.
Figure 4B:
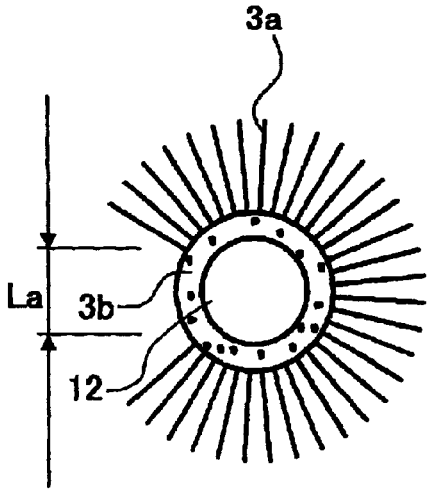
FIG. 4B is a drawing illustrating a sectional view of the fur brush cut along a line indicated by "A—A" in FIG. 4A.
Figure 5:
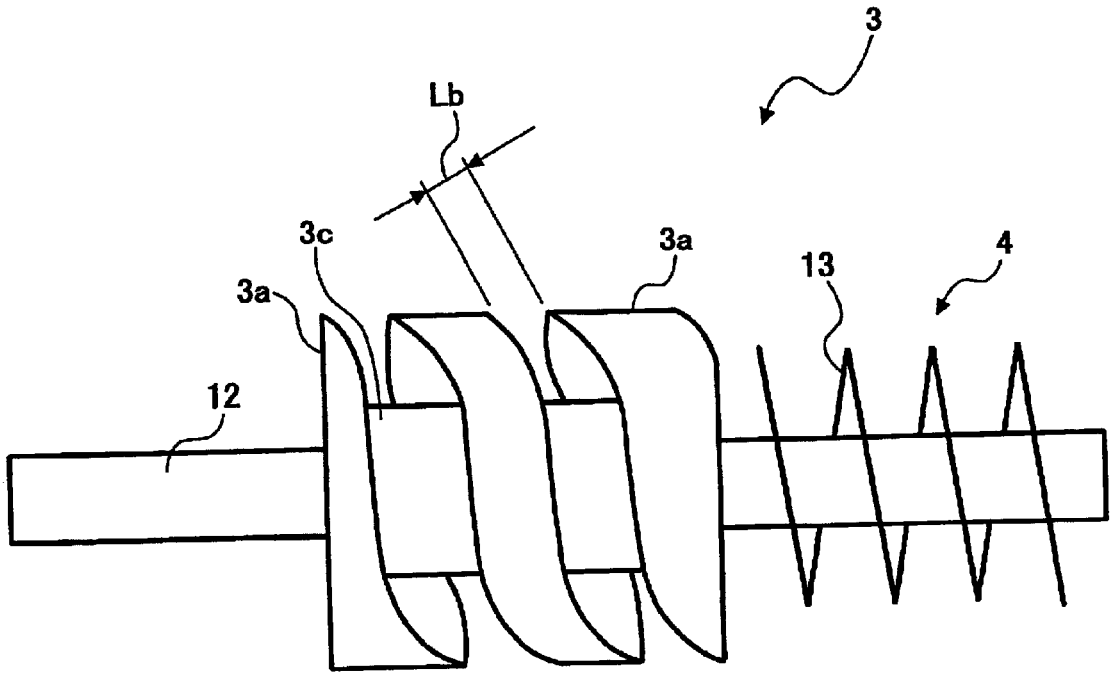
FIG. 5 is a drawing illustrating another example of the fur brush.
Figure 6:
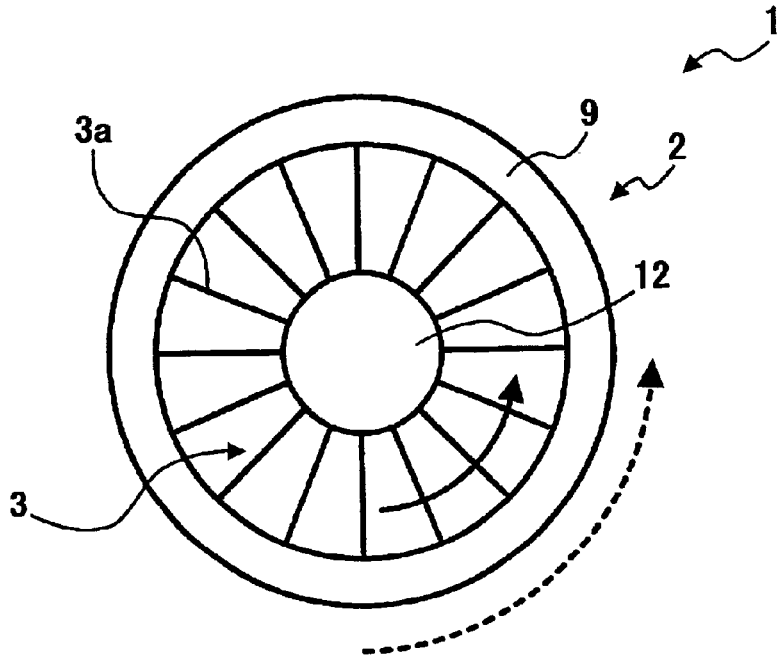
FIG. 6 is a drawing illustrating a sectional view of the recovered toner classifier in FIG. 1 when the recovered toner classifier is operated.
Figure 7:
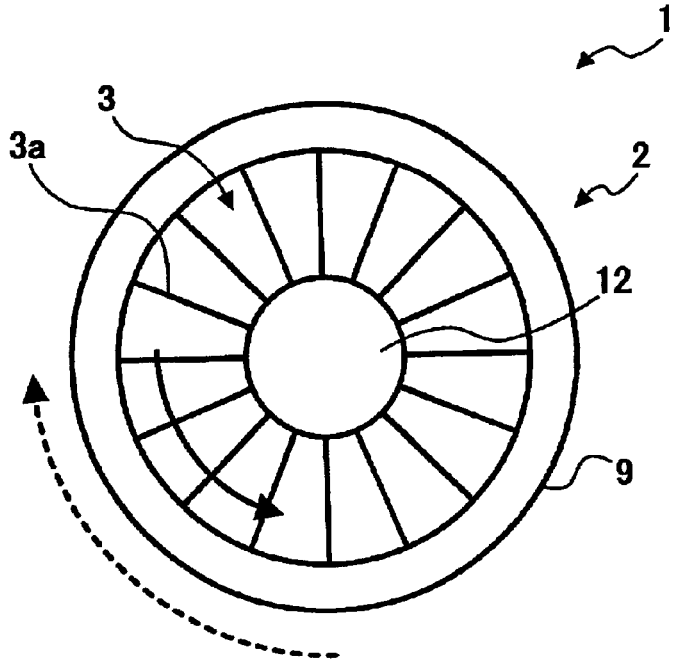
FIG. 7 is a drawing illustrating a sectional view of the recovered toner classifier in FIG. 1 when the recovered toner classifier is operated in a different manner.

Referring to FIGS. 1 through 7, a construction and operation of a recovered toner classifier 1 according to the present invention is described below. FIG. 1 is a schematic drawing illustrating a sectional view of a toner recycle device 100 including the recovered toner classifier 1. FIG. 1 further illustrates main components arranged around the photoconductive drum 16 in an image forming apparatus in which the recovered toner classifier 1 is incorporated. FIG. 2 is a drawing illustrating a longitudinal sectional view of the recovered toner classifier 1. FIG. 3 is a drawing illustrating a perspective view of a main construction of the recovered toner classifier 1. FIGS. 4A and 4B drawings illustrating an example of a fur brush 3 of the recovered toner classifier 1 in which FIG. 4A is a longitudinal sectional view of the fur brush 3 and FIG. 4B is a sectional view of the fur brush 3 cut along a line indicated by "A—A" in FIG. 4A. FIG. 5 is a drawing illustrating another example of the fur brush 3. FIG. 6 is a drawing illustrating a sectional view of the recovered toner classifier 1 when the recovered toner classifier 1 is operated. FIG. 7 is a drawing illustrating a sectional view of the recovered toner classifier 1 when the recovered toner classifier 1 is operated in a different manner.

In FIG. 1, the charging device 17, cleaning device 18, developing device 19, and transfer device 20 are arranged around the photoconductive drum 16. The cleaning device 18 includes a cleaning blade 18*a* and brush roller 18*b*. These cleaning members are provided to remove residual toner remaining on a surface of the photoconductive drum 16 after a toner image has been transferred onto a transfer sheet (not shown). The developing device 19 develops an electrostatic latent image formed on the surface of the photoconductive drum 16 into a toner image using a developer including toner and a carrier. The developing device 19 includes a developing roller 19*a* (i.e., developing sleeve) and agitation paddle 19*b*. The developing roller 19*a* rotates in the same direction in which the photoconductive drum 16 rotates. The agitation paddle 19*b* agitates the developer. The transfer device 20 includes a transfer belt 20*a* that transfers the toner image formed on the surface of the photoconductive drum 16 onto a transfer sheet (not shown). The recovered toner classifier 1 is arranged above the developing device 19.

The recovered toner conveying mechanism 21 (i.e., a screw conveyer) is provided between the cleaning device 18 and developing device 19. The recovered toner conveying mechanism 21 includes a rotating shaft and a screw blade 25 that is provided to the rotating shaft. The recovered toner conveying mechanism 21 is rotatable in a recovered toner conveying pipe 24. The recovered toner conveying mechanism 21 forms a recovered toner conveying path. The recovered toner conveying path includes a first recovered toner conveying path 25*a* and second recovered toner conveying path 25*b*. One end of the first recovered toner conveying path 25*a* is connected to the cleaning device 18. The recovered toner classifier 1 is provided between an end of the recovered toner conveying mechanism 21 and the developing device 19.

The recovered toner classifier 1 is provided in a toner conveying path arranged at an upper portion of the developing device 19. A disposal toner conveying path 22 is branched off from the toner conveying path. The disposal toner conveying path 22 is connected to a disposal toner container 23. An inlet 5 of the recovered toner classifier 1 is connected to the end of the recovered toner conveying mechanism 21. An outlet 6 of the recovered toner classifier 1 is connected to the disposal toner conveying path 22, and an opening of the recovered toner classifier 1 is connected to the developing device 19 (see FIG. 2).

Recovered toner T recovered from a surface of the photoconductive drum 16 by the cleaning device 18 is conveyed to the recovered toner classifier 1 through the first and second recovered toner conveying paths 25*a* and 25*b*. The recovered toner T conveyed into the recovered toner classifier 1 is classified into recycled toner Ta and disposal toner Tb. The recycled toner Ta is reused by the developing device 19. The disposal toner Tb is conveyed to the disposal toner container 23 through the disposal toner conveying path 22. The disposal toner Tb is then disposed of.

In FIG. 1, when an image forming operation is started, the photoconductive drum 16 is rotated by a driving motor (not shown). A surface of the photoconductive drum 16 is uniformly charged by the charging device 17. An electostatic latent image is then formed on the surface of the photoconductive drum 16. The electrostatic latent image is developed into a toner image by the developing device 19 using a developer. The toner image is transferred onto the rotating transfer belt 20*a* (i.e., primary transfer). The toner image is then transferred onto a transfer sheet (not shown) fed from a sheet feeding device (i.e., second transfer). The transfer sheet is conveyed to a fixing device where the toner image is fixed onto the transfer sheet.

Unfixed toner on the transfer sheet is offset on the surface of the photoconductive drum 16. The conductive brush roller 18*b* discharges the offset toner to recover the toner by the cleaning blade 18*a*. The recovered toner is conveyed to the recovered toner classifier 1 by the recovered toner conveying mechanism 21 through the first and second recovered toner conveying paths 25*a* and 25*b*.

Next, a construction and operation of the recovered toner classifier 1 is described referring to FIGS. 2 through 5. The recovered toner classifier 1 includes a main body 2 of the recovered toner classifier 1. The main body 2 includes a cylindrical-shaped filter 9 formed of a mesh (i.e., a net member) and the internal fur brush 3 that slidingly rubs the filter 9. An inlet 5*a* for recovered toner is formed at one end of the filter 9 in the direction of its length while the outlet 6 for disposal toner is formed at the other end of the filter 9. The fineness of the mesh of the filter 9 (i.e., a size of the mesh) is set such that paper lint and aggregations of toner, which are larger than predetermined sizes, are not passed through the mesh. The toner that does not pass through the filter 9 is discharged from the outlet 6.

The filter 9 includes a main body of filter 9*a* formed of metallic or resin wire member and a frame 10 formed of resin. The main body of filter 9*a* is fixedly provided to an inner peripheral surface of the frame 10. Thus, the frame 10 holds the main body of filter 9*a*. A power transmission member 11 such as a gear is connected to one end of the frame 10. A rotation driving mechanism of the filter 9 includes the power transmission member 11 and a power transmission member (not shown) provided to a shaft of a driving motor. Thus, filter 9 rotates integrally with the frame 10.

The fur brush 3 includes a brush 3*a* that is radially provided on an outer peripheral surface of the rotation shaft 12 in a direction perpendicular to the outer peripheral surface of the rotation shaft 12. The filter 9 concentrically contains the fur brush 3. A tip end of the brush 3*a* is in press-contact with a mesh of the filter 9. For example, a diameter of fur brush 3 and a length of the brush 3*a* are set to 26 mm and 6 mm, respectively. The brush 3*a* is not provided on an entire outer peripheral surface of the rotation shaft 12. Thus, a non-brush region is continuously formed on the outer peripheral surface of the rotation shaft 12 from the inlet 5*a* through the outlet 6 along an axis line of the rotation shaft 12.

FIGS. 4A, 4B, and 5 are drawings illustrating a construction of the fur brush 3 having the above-described non-brush region. In FIGS. 4A and 4B, a non-brush region 3*b* is a circumferential portion continuously arranged from the inlet 5*a* through the outlet 6 in a parallel direction to the axis line of the rotation shaft 12. A width La of the circumferentially extending non-brush region 3*b* is set, for example, to 6 mm.

In FIG. 5, the brush 3*a* is spirally provided on the outer peripheral surface of the rotation shaft 12 having a predetermined space in-between the turns of the spiral. Thus, a non-brush region 3*c* is spirally and continuously formed on the outer peripheral surface of the rotation shaft 12 from the inlet 5*a* through the outlet 6 along the axis line of the rotation shaft 12. A width Lb of the non-brush region 3*c* is set, for example, to 6 mm.

An inlet tube 4*a* surrounds a lower half portion of a screw conveyer 4. The screw conveyer 4 includes a screw blade 13 provided to a portion of the rotation shaft 12 on the side of the inlet 5*a*. A size of the mesh of the filter 9 is, for example, set to approximately 200 meshes. The frame is formed of a resin mold, such as polyacetal and polybutyleneterephthalate.

One end of the rotation shaft 12 is supported by a bearing (not shown) provided to a side wall of the inlet 5. A driving gear (not shown) is provided to the other end of the rotation shaft 12. The driving gear is engaged with a gear (not shown) provided to a shaft of a driving motor. The filter 9 and fur brush 3 rotate in the same direction or in a different direction. When the filter 9 and fur brush 3 rotate in the same direction, they rotate at different circumferential velocities. When the filter 9 and fur brush 3 rotate in a different direction, they rotate at different circumferential velocities or at the same circumferential velocity. FIG. 6 is a drawing illustrating the filter 9 and fur brush 3 rotating in the same direction at different circumferential velocities. FIG. 7 is a drawing illustrating the filter 9 and fur brush 3 rotating in a different direction.

In FIGS. 2 through 4, when the recovered toner classifier 1 is driven, the fur brush 3 and screw conveyer 4 are integrally rotated by a rotation of the rotation shaft 12. At the same time, the filter 9 is rotated by a rotation of the power transmission member 11. The filter 9 is, for example, rotated in a reverse direction of the fur brush 3. The recovered toner T at the inlet 5 is conveyed into the recovered toner classifier 1. The recovered toner T is then conveyed to the non-brush region 3*b* of the fur brush 3 through the inlet 5*a* by the screw conveyer 4.

The recovered toner T in the non-brush region 3*b* is conveyed toward the outlet 6 while being pushed by the following recovered toner T in an axis line direction of the rotation shaft 12. A classification process of the recovered toner T is performed during the above-described conveyance of the recovered toner T. The recovered toner T moves to the mesh of the filter 9 by centrifugal force generated by a rotation of the fur brush 3. Toner having a small diameter passes through the mesh of the filter 9. The toner is then discharged from the opening 8 so that the toner is conveyed to the developing device 19. The brush 3*a* pushes the recovered toner T against the mesh of the filter 9 while brushing the mesh of the filter with a tip portion thereof such that the toner having a small diameter passes through the mesh of the filter 9. A portion of the fur brush 3 other than the tip portion of the brush 3*a* also brushes toner and paper lint. Large paper lint, which does not pass through the mesh of the filter 9, is conveyed to the outlet 6. The large paper lint is then discharged to the disposal toner conveying path 22. A part of an aggregation of toner in the recovered toner T is stirred and crushed by the brush 3*a* of the fur brush 3. At the same time, because the brush 3*a* brushes the mesh of the filter 9, a clogging up of the filter 9 with toner or paper lint is prevented. A part of the aggregation of toner, which is not crushed by the brush 3*a*, is discharged from the outlet 6. In the recovered toner classifier 1, the brush 3*a* of the fur brush 3 is uniformly in press-contact with the mesh of the filter 9. In addition, the press-contacting position of the brush 3*a* changes with respect to time. Thus, classification of the recovered toner T is stably and effectively performed.

The fur brush 3 in FIGS. 4A and 4B includes the non-brush region 3*b* in the manner illustrated. Because the recovered toner T is classified while the recovered toner T is conveyed toward the outlet 6 via the non-brush region 3*b*, an occurrence of a phenomenon in which the recovered toner T on the side of the inlet 5*a* is mainly classified, is prevented. Hence, the recovered toner T is uniformly classified through the recovered toner classifier 1, resulting in an effective removal of an aggregation of toner and paper lint.

In FIG. 5, the fur brush 3 includes the non-brush region 3*c*, which is spirally formed having a predetermined space in-between, so that the brush 3*a* conveys toner. Thus, a conveying function of the recovered toner T into the recovered toner classifier 1 from the inlet 5*a* is enhanced compared to the fur brush 3 in FIGS. 4A and 4B. In addition, because a period of time in which the brush 3*a* contacts the mesh of the filter 9 is prolonged, an efficiency of toner recovery is increased.

Factors in determining a function of each of the above-described recovered toner classifiers 1 include: (1) a circumferential velocity of the fur brush 3 and filter 9, and their relative circumferential velocity, (2) a size of the mesh of the filter 9, and a diameter of a net member that forms the mesh, (3) a length of the fur brush 3 in the direction of the rotation shaft 12, and a diameter and length of the brush 3*a*, (4) a diameter and length of the filter 9, and (5) a shape and width of a non-brush region.

Figure 8:
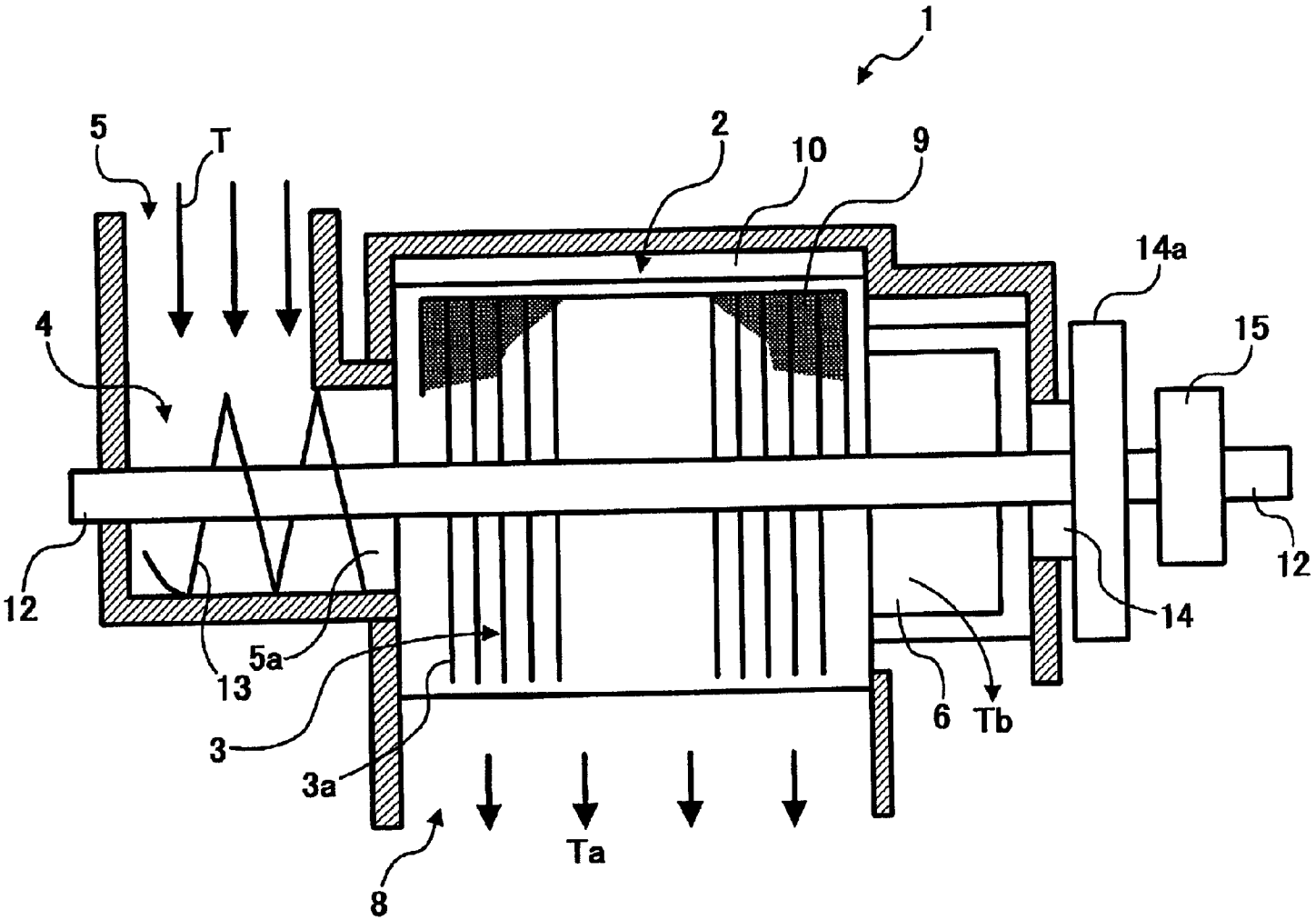
FIG. 8 is a drawing illustrating a longitudinal sectional view of a recovered toner classifier according to a second example of the present invention.

A second example of the present invention: FIG. 8 is a drawing illustrating a longitudinal sectional view of the recovered toner classifier. A first driving gear 14*a* is fixedly provided to a rotation shaft 14 of the filter 9. The first driving gear 14*a* is engaged with a gear (not shown) provided to a rotation shaft of a driving motor via a first transmission gear (not shown). A second driving gear 15 is fixedly provided to the rotation shaft 12 of the fur brush 3. The second driving gear 15 is engaged with the gear provided to the rotation shaft of the driving motor via a second transmission gear (not shown). With this arrangement, the filter 9 and fur brush 3 rotate at different circumferential velocities but in the same direction, as illustrated in FIG. 6 by respective rotations of the first and second driving gears 14*a* and 15.

In the recovered toner classifier 1 in FIG. 8, the filter 9 and fur brush 3 rotate in different directions from each other if a gear (not shown) is provided between the first driving gear 14*a* and transmission gear to change a rotating direction of the first driving gear 14*a*. Respective rotation speeds of the filter 9 and fur brush 3 are independently changed if appropriate gears are provided to the first transmission gear and second transmission gear, respectively.

Figure 9:
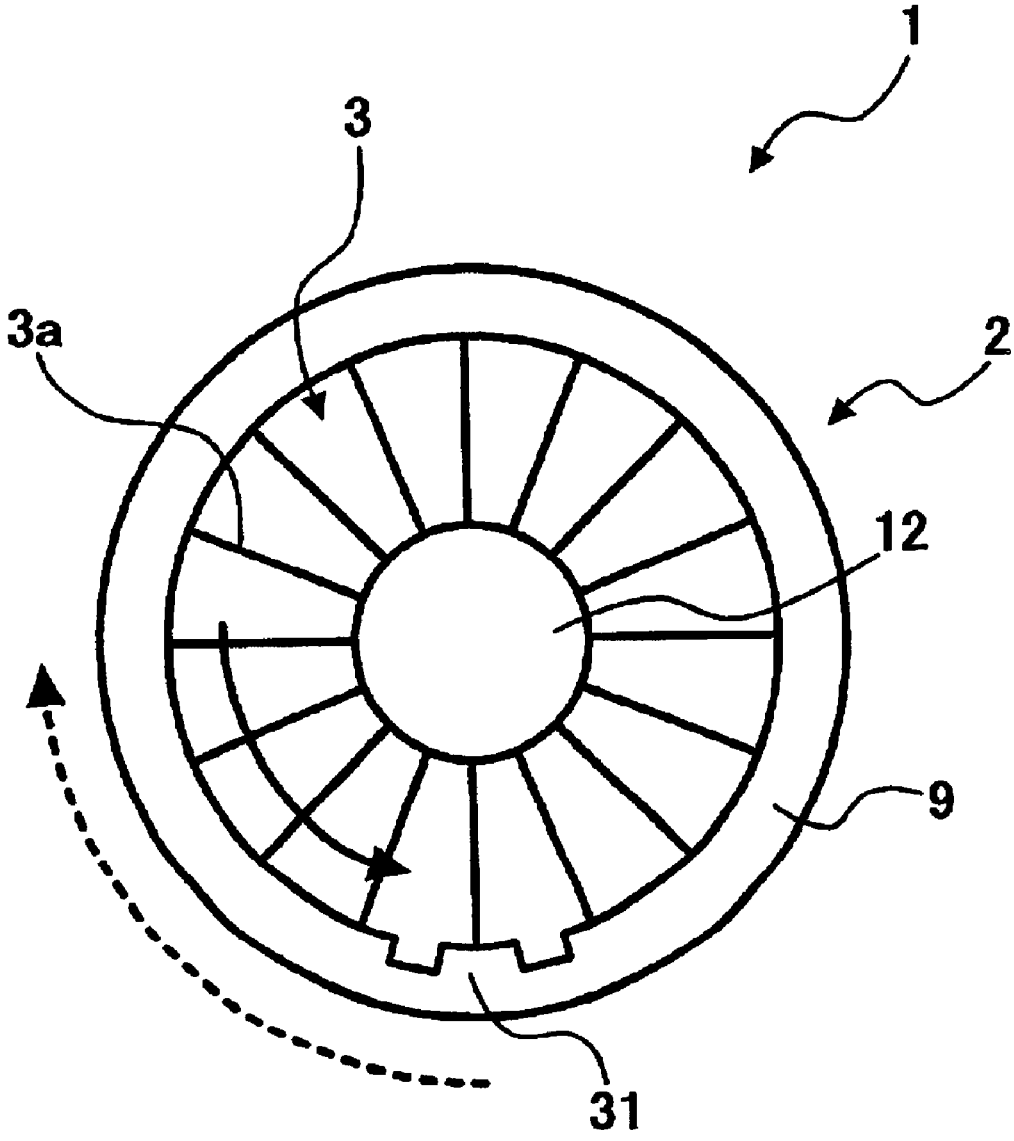
FIG. 9 is a drawing illustrating a sectional view of main construction of the recovered toner classifier according to a third example of the present invention.

A third example of the present invention: FIG. 9 is a drawing illustrating a sectional view of main construction of the recovered toner classifier 1 according to the third example of the present invention. A projection 31 is formed on an inner surface of the cylindrical-shaped filter 9. When the filter 9 rotates, a tip portion of the brush 3*a* flicks the projection 31. Thus, toner adhered to the tip portion of the brush 3*a* is removed by the flick such that the tip portion of the brush 3*a* stably performs its function.

Figure 10:
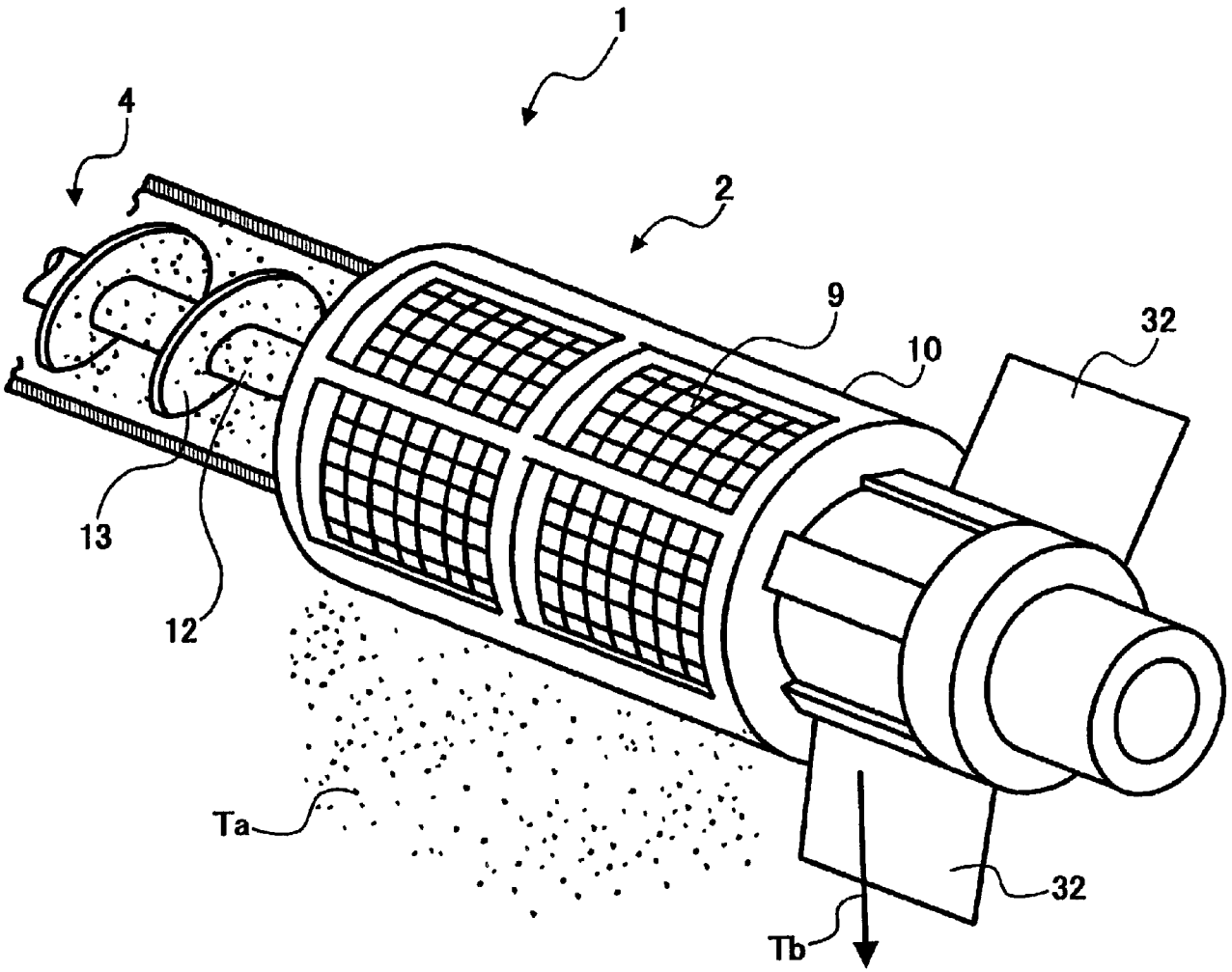
FIG. 10 is a drawing illustrating a sectional view of main construction of the recovered toner classifier according to a fourth example of the present invention; and, FIG. 11 is a drawing illustrating a sectional view a toner recycle device in a background art.
Figure 11:
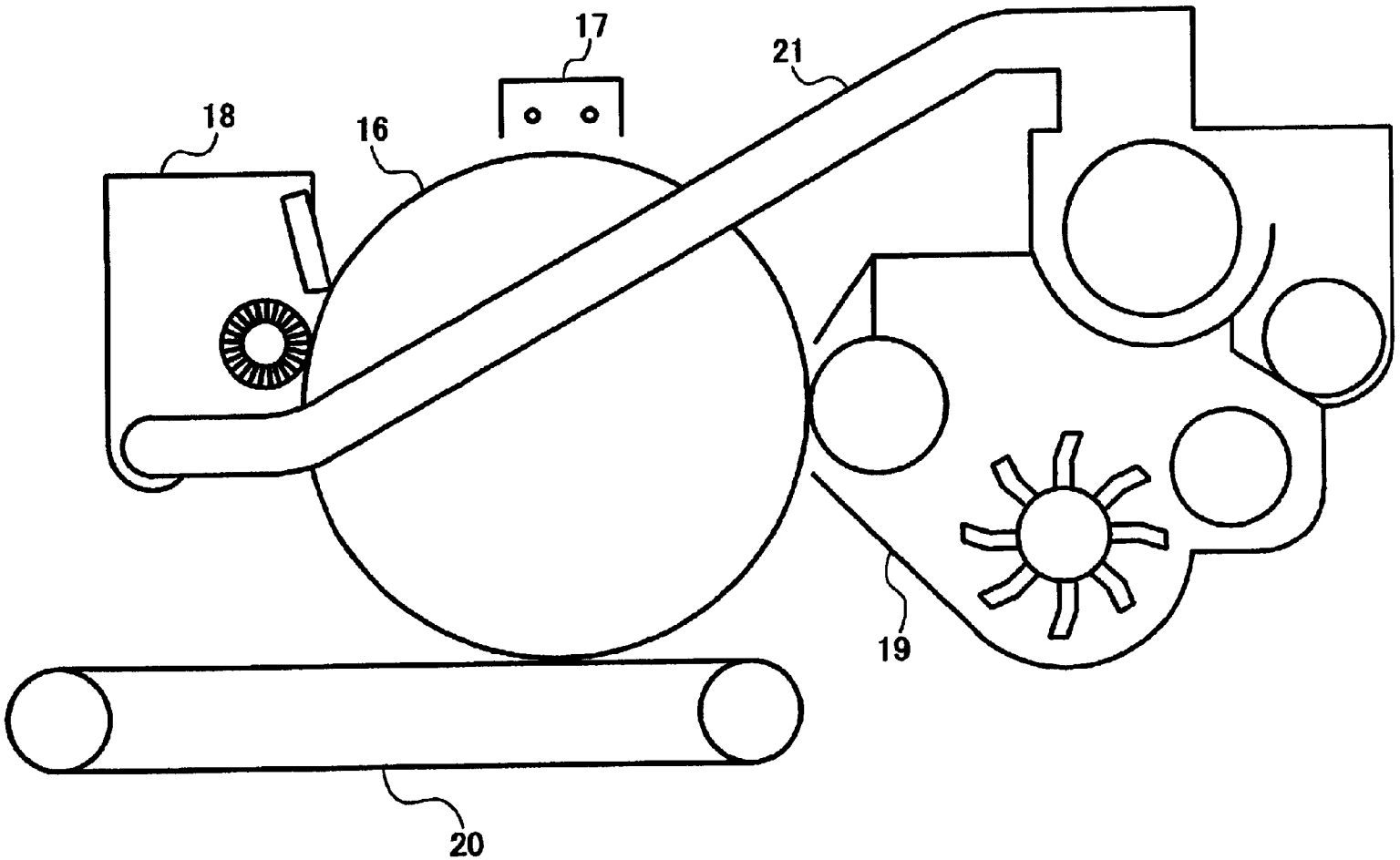
FIG. 11 PRIOR ART

A fourth example of the present invention: FIG. 10 is a drawing illustrating a sectional view of a main construction of the recovered toner classifier 1 according to the fourth example of the present invention. In the recovered toner classifier 1, a paddle 32 is provided to a portion of the filter that forms the outlet 6. The paddle 32 integrally rotates with the filter 9. With this construction, the disposal toner Tb that tends to stay at the outlet 6 is smoothly discharged to the disposal toner conveying path 22. It is preferable that the projection 31 and paddle 32 are arranged together.

Obviously, numerous additional modifications and variations of the present invention are possible in light of the above teachings. It is therefore to be understood that within the scope of the appended claims, the present invention may be practiced otherwise than specifically described herein. The recovered toner classifier according to an example of the present invention is applied not limited to a copying machine, but also applied to an image forming apparatus such as a printer, a facsimile and other similar devices. In the above-described examples of the present invention, a cleaning device cleans residual toner remaining on a surface of a photoconductive drum, however, the cleaning device is applied to clean residual toner remaining on a transfer belt or residual toner remaining on a conveying device that conveys a transfer sheet having a toner image thereon to a fixing device.

This document claims priority and contains subject matter related to Japanese Patent Application No. 2001-064742, filed on Mar. 8, 2001, Japanese Patent Application No. 2002-12412, filed on Jan. 22, 2002, and Japanese Patent Application No. 2002-32063, filed on Feb. 8, 2002, and the entire contents thereof are herein incorporated by reference.

What is claimed is:

1. A recovered toner classifier in an image forming apparatus, comprising: a net member positioned to receive toner recovered from an image forming operation; and a brush member movable relative to the net member and configured to slidingly rub the net member during the relative movement, wherein the recovered toner is conveyed and classified in the net member, wherein: the net member comprises a filter having an inlet for the recovered toner at one end of the filter in a direction of a length of the cylindrical-shaped filter and an outlet for discharging disposal toner at the other end of the filter, the filter being rotatable around a central axis thereof; the brush member comprises a rotatable shaft, a fur brush spirally provided on an outer peripheral surface of the shaft for rotation integrally with the shaft and a non-brush region continuously formed on the shaft from the inlet of the filter to the outlet of the filter, wherein the fur brush is concentrically positioned in the filter such that a tip portion of the fur brush is in press-contact with an inner peripheral surface of the filter; and a screw conveyer having a screw provided on a portion of the shaft upstream of the inlet of the filter, and configured to convey the recovered toner to the inlet of the filter.

2. The recovered toner classifier according to claim 1, wherein the filter and fur brush are driven to rotate at a different circumferential velocities from each other and in the same direction.

3. The recovered toner classifier according to claim 1, wherein the filter and fur brush are driven to rotate in different directions from each other.

4. The recovered toner classifier according to claim 2, wherein the non-brush region of the brush member is formed in parallel with the axis of the shaft.

5. The recovered toner classifier according to claim 3, wherein the non-brush region of the brush member is formed in parallel with the axis of the shaft.

6. The recovered toner classifier according to claim 2, wherein the fur brush of the brush member is a spiral brush spirally provided on an outer peripheral surface of the shaft, with a predetermined space between turns of the spiral brush.

7. The recovered toner classifier according to claim 3, wherein the fur brush of the brush member is a spiral brush spirally provided on an outer peripheral surface of the shaft, with a predetermined space between turns of the spiral brush.

8. The recovered toner classifier according to claim 1, wherein the filter further comprises: a main including a wire member formed of one of metal and resin; and a frame formed of resin, wherein the main body of the filter is fixedly provided to an inner peripheral surface of the frame.

9. The recovered toner classifier according to claim 1, further comprising a projection formed on the inner peripheral surface of the filter, wherein the rotating tip portion of the brush is positioned to flick the projection during the relative movement.

10. The recovered toner classifier according to claim 1, further comprising: a paddle provided to a portion of the filter that forms the outlet for the disposal toner, the paddle being configured to rotate integrally with the filter.

11. A method for classifying recovered toner, comprising the steps of: rotating a cylindrical-shaped filter having an inlet for the recovered toner at one axial end of the filter in a direction of a length of the filter and an outlet for discharging disposal toner at the other axial end of the filter; rotating a fur brush in the filter integrally with rotation of a shaft while a tip portion of a brush is in press-contact with an inner peripheral surface of the filter, the fur brush being spirally provided on an outer peripheral surface of the shaft and a non-brush region being continuously formed from the inlet of the filter to the outlet of the filter; and rotating a screw conveyer upstream of the inlet of the filter to convey the recovered toner to the inlet of the filter.

12. The method according to claim 11, further comprising: rotating the filter and fur brush at a different circumferential velocities from each other and in the same direction.

13. The method according to claim 11, further comprising: rotating the filter and fur brush in different directions from each other.

14. A recovered toner classifier in an image forming apparatus, comprising: a net member positioned to receive toner recovered from an image forming operation; and brush means for slidingly rubbing the net member, wherein the recovered toner is conveyed and classified, wherein: the net member comprises a filter having an inlet for the recovered toner at one end of the filter in a direction of a length of the cylindrical-shaped filter and an outlet for discharging disposal toner at the other end of the filter, the filter being rotatable around a central axis thereof; the brush means comprises a rotatable shaft, a fur brush spirally provided on an outer peripheral surface of the shaft for rotation integrally with the shaft and a non-brush region continuously formed on the shaft from the inlet of the filter to the outlet of the filter, wherein the fur brush is concentrically positioned in the filter such that a tip portion of the fur brush is in press-contact with an inner peripheral surface of the filter; and a screw conveying means having a screw provided on a portion of the shaft upstream of the inlet of the filter, to convey the recovered toner to the inlet of the filter.

15. The recovered toner classifier according to claim 14, wherein the filter and brush means rotate at a different circumferential velocities from each other in the same direction.

16. The recovered toner classifier according to claim 14, wherein the filter and brush means rotate in a different directions from each other.

17. The recovered toner classifier according to claim 15, wherein the non-brush region of the brush means is formed in parallel with the axis of the shaft.

18. The recovered toner classifier according to claim 16, wherein the non-brush region of the brush means is formed in parallel with the axis of the shaft.

19. The recovered toner classifier according to claim 15, wherein the brush of the brush means is spirally provided on the outer peripheral surface of the shaft, with a predetermined space between turns of the spiral brush.

20. The recovered toner classifier according to claim 16, wherein the brush of the brush means is spirally provided on the outer peripheral surface of the shaft, with a predetermined space between turns of the spiral brush.

21. The recovered toner classifier according to claim 14, wherein the filter further comprises: a main body comprises a wire member formed of one of metal and resin; and a frame formed of resin, wherein the main body of the filter is fixedly provided to an inner peripheral surface of the frame.

22. The recovered toner classifier according to claim 14, further comprising a projection formed on the inner peripheral surface of the filter, wherein the rotating tip portion of the brush is positioned to flick the projection during the relative movement.

23. The recovered toner classifier according to claim 14, further comprising: a paddle provided to a portion of the filter that forms the outlet for the disposal toner, the paddle being configured to rotate integrally with the filter.

* * * * *